United States Patent [19]

Puligandla et al.

[11] Patent Number: 4,473,602

[45] Date of Patent: Sep. 25, 1984

[54] PALLADIUM ACTIVATION OF 2.5% SILICON IRON PRIOR TO ELECTROLESS NICKEL PLATING

[75] Inventors: Viswanadham Puligandla; Deepak K. Verma, both of Rochester, Minn.

[73] Assignee: International Business Machines Corporation, Armonk, N.Y.

[21] Appl. No.: 454,525

[22] Filed: Dec. 30, 1982

[51] Int. Cl.[3] ..... B05D 3/04; B05D 3/10

[52] U.S. Cl. ..... 427/305; 427/309; 427/343; 427/347; 427/353; 427/383.7; 427/405; 427/438

[58] Field of Search ..... 427/309, 241, 328, 305, 427/343, 353, 347, 380, 383.3, 383.7, 405, 438; 156/664; 252/79.3; 134/3

[56] References Cited

U.S. PATENT DOCUMENTS

| | | | |
|---|---|---|---|
| 2,532,283 | 12/1950 | Brenner et al. | 427/305 |
| 3,078,180 | 2/1963 | Zander et al. | 427/309 |
| 3,309,760 | 3/1967 | Reznick et al. | 427/309 |
| 3,316,625 | 5/1967 | Flint et al. | 427/347 |
| 3,639,143 | 2/1972 | Lussow et al. | 427/309 |
| 3,785,866 | 1/1974 | Frey | 134/3 |
| 4,042,730 | 8/1977 | Cohen et al. | 427/305 |
| 4,237,154 | 12/1980 | Garrison | 427/241 |

*Primary Examiner*—Sadie L. Childs

*Attorney, Agent, or Firm*—Joseph E. Kieninger

[57] ABSTRACT

A method for electroless nickel plating of silicon-iron which has been heat treated prior to the plating operation and subjected to thermal shock after the plating operation includes the steps of cleaning the surface of the silicon-iron with a fluoride etch salt, forming a thin deposit of palladium on the clean surface of the silicon-iron, hardening the palladium deposit by treatment with a solution of ammonium hydroxide and nickel plating the silicon-iron using an electroless nickel plating solution, followed by baking at about 250° F. for about six hours.

7 Claims, No Drawings

PALLADIUM ACTIVATION OF 2.5% SILICON IRON PRIOR TO ELECTROLESS NICKEL PLATING

DESCRIPTION

1. Technical Field

This invention relates to silicon-iron and more particularly to palladium activation of silicon-iron prior to electroless nickel plating.

2. Background Art

Printer actuator armatures made of 2.5% silicon-iron are electroless nickel plated after case hardening. The purpose of the nickel plating is two-fold. First, the nickel plating provides corrosion protection prior to service application and second, it provides brazability by aiding even braze flow during subsequent brazing of the nickel plated armatures to the print wires in the inner diameter of the armature. The nickel plating is normally a 9% phosphorous-nickel alloy having a eutectic temperature of approximately 1625° F. After nickel plating the armatures are heated to 1450° F. in three seconds during brazing and then water-quenched to room temperatures. This extreme thermal shock invariably results in blistered plating on the outer diameter of the armatures, thereby spoiling the surface finish and jeopardizing the functional requirements of the part. The plating blisters primarily due to the lack of adhesion by the nickel plating to withstand the extreme thermal shock during the brazing operation. Attempts to improve the adhesion of the nickel plating by blasting the substrate with a proper blasting medium and descaling to remove the scales from the prior case hardening operation and then followed by ultrasonic cleaning and acid pickling prior to electroless nickel plating did not improve the adhesion sufficiently to eliminate the blisters.

Palladium activation has been used to provide the necessary activation on copper subtrates to accept and adhere to the nickel plating. Palladium activation on nometallic surfaces to improve the adhesion with electroless copper plating has been described in U.S. Pat. No. 4,042,730.

Palladium activation alone of 2.5% silicon-iron surfaces prior to electroless nickel plating has not improved the adhesion of the nickel plating significantly. Apparently the presence of silicon in the iron causes poor adhesion of the nickel even with the palladium activation.

SUMMARY OF THE INVENTION

A method for electroless nickel plating of silicon-iron which has been case hardened prior to the plating operation and subjected to thermal shock after the plating operation includes the steps of cleaning the surface of the silicon-iron with an alkaline cleaner, such as one containing sodium hydroxide, followed by a water rinse, then the surface is cleaned with an acid cleaner with fluoride etch salts followed by a water rinse; then forming a thin deposit of palladium on the clean surface of the silicon iron, hardening the palladium deposit by treatment with a solution of ammonium hydroxide followed by a water rinse; nickel plating the silicon-iron using an electroless nickel plating solution; rinsing the silicon-iron surface with water; spin drying the silicon-iron; and baking the silicon-iron at a temperature of the order of 250° F. for about six hours.

DESCRIPTION OF THE PREFERRED EMBODIMENT

The first step in this process is to treat the surface of the 2.5% silicon-iron parts which have been case hardened with an alkaline cleaner. Various alkaline agents may be used. Preferred bases are sodium hydroxide and potassium hydroxide because of their ready availability and ease with which they can be removed from surfaces. The basic solution of sodium hydroxide in the concentration range of 1.0 to 2.0 molar is preferred because it is inexpensive, nonvolatile and commercially available. The silicon-iron part is immersed for about three minutes in the alkaline cleaner which is at a temperature of the order of 185° F. The silicon-iron part is then rinsed with deionized water at ambient temperature for one minute.

The next step is to immerse the silicon-iron part for 30 seconds in an acid cleaner with fluoride etch salt cleaning solution. Such cleaning salts are commercially available fluoride salts and include acid bisulfate salts of sodium and potassium. After the acid-fluoride etch the part is rinsed with deionized water again at ambient temperature for one minute. It is necessary to have this acid-fluoride salt etch step in order to avoid getting blisters in the nickel plating after it has been exposed to thermal shock.

The next step is to activate the silicon-iron surface by providing a thin layer of palladium thereon. The palladium layer is deposited by using an aqueous solution of palladium dichloride acidified generally with hydrochloric acid. A typical solution has between 0.02 to 2 grams palladium dichloride per liter of solution and 0.02 to 20 milliliters hydrochloric acid per liter of solution. A specific solution that was used contains one gram of palladium dichloride and 0.2 milliliters of hydrochloric acid per liter of solution. The part is dipped into the acidified palladium dichloride solution for about one minute at ambient temperature. The time of exposure may vary typically between 10 seconds and 5 minutes. Approximately 30 seconds to one minute is sufficient in most cases. The part is then rinsed in deionized water. While the water rinse is not vital to the process, it does prevent contamination of the various solutions which prolongs their useful life. The silicon-iron part is then subjected to an ammonium hydroxide treatment for one minute. Ammonium hydroxide solution contains one part of ammonia and two parts of water.

The electroless deposition of nickel is carried out by conventional means using conventional electroless nickel baths. A great variety of bath compositions and procedures may be used. These are described in "Electroless Nickel Plating—A Review" by Lester F. Spencer; Metal Finishing, pp. 35–39, October 1974. One such bath is ELNIC C-5 plating solution which was used.

A typical electroless nickel solution contains a nickel salt such as nickel sulfate, a complexing agent such as carboxylic acids or their salts, a reducing agent such as sodium hypophosphite and sufficient base such as ammonium hydroxide to obtain a Ph of at least 4.5. Typical concentrations are from 0.002M to 0.15M for the nickel salt; from 0.003M to 1M for the complexing agent; and from 0.02M to 2M for the reducing agent. The time that the surface should be exposed to the electroless plating solution may vary over large limits depending generally upon the plating conditions and the thickness desired. Times exceeding one hour are usually not profitable because increase in the plating thickness obtained after one hour is usually not particularly profitable. Although the electroless nickel procedure is most conveniently carried out at room temperature, elevated temperatures up to the boiling point of the electroless solution may be useful at times.

After the nickel coating has been deposited, the part is rinsed with deionized water, spin dried and baked at a temperature of the order of 250° F. for six hours. The part is now ready for the subsequent brazing operating.

In a specific application, nickel plated armatures are then brazed to the print wires in the inner diameter of the armature. The armatures are heated to a temperature of 1450° in three seconds during brazing and then water-quenched to room temperature. Nickel plated armatures made in accordance with this invention are substantially blister free after being subjected to this extreme thermal shock.

Although a preferred embodiment of this invention has been described, it is understood that numerous variations may be made in accordance with the principle of this invention.

What is claimed is:

1. A method for the electroless nickel plating of silicon-iron which has been case hardened prior to the plating operation and subjected to thermal shock after the plating operation comprising the steps of:

cleaning and etching the surface of the case hardened silicon-iron with a fluoride etch salt, forming a thin deposit of palladium on the clean surface of the silicon-iron, hardening the palladium deposit by treatment with a solution of ammonium hydroxide and, nickel plating the silicon-iron using an electroless nickel plating solution before the silicon-iron is subjected to a thermal shock of the order of 1450° F.

2. A method as described in claim 1 including the step of cleaning the surface of the slicon-iron with an alkaline cleaner prior to the fluoride etch step.

3. A method as described in claim 2 including the step of rinsing with deionized water afte cleaning with the alkaline cleaner.

4. A method as described in claim 1 whereby the fluoride etch salt is sodium and potassium fluoro bisulfate.

5. A method as described in claim 1 whereby the thin palladium deposit is formed by dipping the silicon-iron into a $PdCl_2$-HCl solution.

6. A method as described in claim 1 whereby the solution of ammonium hydroxide contains one part $H_2O$ to two parts ammonium hydroxide.

7. A method for the electroless nickel plating of silicon-iron which has been case hardened prior to the plating operation and subjected to a thermal shock of the order of 1450° F. after the plating operation comprising the steps of:

cleaning the surface of the case hardened silicon-iron with an alkaline cleaner, rinsing the alkaline cleaned silicon-iron surface with deionized water, clenaing the silicon-iron with an acid cleaner-fluoride etch salt, rinsing the silicon-iron surface with deionized water, forming a thin deposit of palladium on the clean surface of the silicon-iron, hardening the palladium deposit with a solution of ammonium hydroxide, rinsing the silicon-iron with deionized water, and nickel plating the silicon-iron using an electroless nickel plating solution, and rinsing the silicon-iron with deionized water, spin drying the silicon-iron, and baking the silicon-iron at a temperature of the order of 250° F. for about six hours before the silicon-iron is subjected to a thermal shock of the order of 1450° F.

* * * * *

UNITED STATES PATENT AND TRADEMARK OFFICE

CERTIFICATE OF CORRECTION

PATENT NO. : 4,473,602

DATED : September 25, 1984

INVENTOR(S) : VISWANADHAM PULIGANDLA ET AL

It is certified that error appears in the above—identified patent and that said Letters Patent is hereby corrected as shown below:

Claim 6 should read as follows:

6. (Amended) A method as described in claim 1 whereby the solution of ammonium hydroxide contains [one part] two parts $H_2O$ and [two parts] one part ammonium hydroxide.

Signed and Sealed this

*Twenty-eighth* Day of *May 1985*

[SEAL]

*Attest:*

DONALD J. QUIGG

*Attesting Officer* *Acting Commissioner of Patents and Trademarks*